US009770620B2

(12) United States Patent
Ho et al.

(10) Patent No.: US 9,770,620 B2
(45) Date of Patent: Sep. 26, 2017

(54) ELASTIC TORSION DEVICE

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 14 days.

(21) Appl. No.: 14/793,680

(22) Filed: Jul. 7, 2015

(65) Prior Publication Data

US 2017/0007872 A1 Jan. 12, 2017

(51) Int. Cl.
*A63B 21/00* (2006.01)
*A63B 21/02* (2006.01)
(Continued)

(52) U.S. Cl.
CPC .... *A63B 21/4047* (2015.10); *A63B 21/00069* (2013.01); *A63B 21/028* (2013.01);
(Continued)

(58) Field of Classification Search
CPC ..... A63B 21/0004; A63B 21/000043; A63B 21/00058; A63B 21/00069; A63B 21/00076; A63B 21/00178; A63B 21/00181; A63B 21/00185; A63B 21/002; A63B 21/0023; A63B 21/02; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/0607; A63B 21/068; A63B 21/15; A63B 21/159; A63B 21/4023; A63B 21/4033; A63B 21/4035; A63B 21/4043; A63B 21/4045; A63B 21/4047; A63B 21/4049; A63B 23/035; A63B 23/03516; A63B 23/12; A63B 23/1209; A63B 23/1245; A63B 23/1281;
(Continued)

(56) References Cited

U.S. PATENT DOCUMENTS 3,371,927 A * 3/1968 Ryan ..... A63B 25/08 267/153
5,460,565 A * 10/1995 Perneczky ..... B21B 28/04 451/162

(Continued)

*Primary Examiner* — Sandhara Ganesan
*Assistant Examiner* — Gary D Urbiel Goldner
(74) *Attorney, Agent, or Firm* — Blakely, Sokoloff, Taylor & Zafman LLP

(57) ABSTRACT

A torsion pivot device including an elastic element having an axis in a longitudinal direction is described. Two or more pivot structures may be engaged with separate portions of the elastic element along the axis to allow the pivot structures to exert torque force to the separate portions of the elastic element. An axial guide mechanism may be defined through the elastic element substantially along the axis. The pivot structures may be rotatably coupled with the elastic element via the axial guide mechanism to allow the pivot structures to pivot or rotate relative to each other around the axis. The elastic element may be deformed by the torque force via the pivoting or rotation of the pivot structures. Twisting tension may be induced by the deformed elastic element to counter the torque force.

13 Claims, 9 Drawing Sheets

(51) Int. Cl.

| | |
|---|---|
| ***A63B 21/04*** | (2006.01) |
| ***A63B 21/045*** | (2006.01) |
| ***A63B 23/00*** | (2006.01) |
| ***A63B 23/035*** | (2006.01) |

(52) U.S. Cl.
CPC ..... *A63B 21/0414* (2013.01); *A63B 21/0455* (2013.01); *A63B 21/4035* (2015.10); *A63B 21/0004* (2013.01); *A63B 21/00061* (2013.01); *A63B 23/03541* (2013.01); *A63B 2023/003* (2013.01)

(58) Field of Classification Search
CPC ... A63B 23/129; A63B 23/14; A63B 71/0054; A63B 2071/0063; A63B 2071/0072; A63B 2071/0081; A63B 2071/009; A63B 2225/00; A63B 2225/09
See application file for complete search history.

(56) References Cited

U.S. PATENT DOCUMENTS

| | | | | |
|---|---|---|---|---|
| 6,382,572 | B1 * | 5/2002 | Lin | A63B 55/53 206/315.7 |
| 2008/0061614 | A1 * | 3/2008 | Masunaga | A47C 1/03255 297/285 |

* cited by examiner

ELASTIC TORSION DEVICE

FIELD OF INVENTION

The present invention relates generally to torsion force inducing devices, and in particular, resilient pivoting structures applicable for exercising machines.

BACKGROUND

With the growing awareness of health problems caused by lack of exercise, the popularity of exercise machines has steadily increased. These machines may be designed with resilient components to provide counter forces against movements exerted by users for exercising purposes. Typically, the resilient components are driven by force generating mechanisms based on, for example, oil pressure, air pressure, or spring elements, etc. However, these mechanisms may be complicated in structure, costly to construct, hard to maintain, and heavy in weight.

Therefore, there is a need for improved resilient components to provide better exercise machines.

SUMMARY OF THE DESCRIPTION

An elastic torsion device can include a side rotable structure pivotably coupled with a middle rotable structure around a pivot rod via an elastic element. The side rotable structure may house two longitudinal ends of the elastic element. The pivot rod may be defined within a longitudinal passage through the elastic element. The middle rotable structure may be transversely coupled with the elastic element, for example, over the outer surface of the elastic element. External torque force may be applied to rotate or pivot the side rotable structure or the middle rotable structure relative to each other around the pivot rod, hence to twist the elastic element. A counter torque force can be induced by the twisted elastic element to provide resilience (or reciprocating force) in the torsion device. The elastic torsion device can be manufactured and assembled in a simple, economic and light-weighted manner.

In one embodiment, an exercise machine can include an elastic element having an axis in a longitudinal direction. Two or more pivot structures may be engaged with separate portions of the elastic element along the axis to allow the pivot structures to exert torque force to the separate portions of the elastic element. An axial guide mechanism may be defined through the elastic element substantially along the axis. The pivot structures may be rotatably coupled with the elastic element via the axial guide mechanism to allow the pivot structures to pivot or rotate relative to each other around the axis. The elastic element may be deformed by the torque force via the pivoting or rotation of the pivot structures. Twisting tension may be induced by the deformed elastic element to counter the torque force.

In another embodiment, a torsion pivot device may include an elastic element having an axis in a longitudinal direction, a first pivot assembly, a second pivot assembly, an axial guide mechanism and a control mechanism. The first pivot assembly may be engaged with a middle portion of the elastic element along the axis. The second pivot assembly may be engaged with end portions of the elastic element along the axis. The middle portion may be located longitudinally between the end portions of the elastic element. The axial guide mechanism may be defined through the elastic element substantially along the axis. The first and second pivot assemblies may be rotatably coupled with the elastic element via the axial guide mechanism to allow the first pivot assembly and the second pivot assembly to pivot relative to each other around the axis via a torque force to generate twisting tension via the elastic element. Longitudinal length of the elastic element may be configured via the control mechanism to adjust strength of the twisting tension.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further, specific numeric references such as first, second, third, etc., may be made. However, the specific numeric references should not be interpreted as a literal sequential order but rather interpreted as references to different objects. Thus, the specific details set forth herein are merely exemplary. The specific details may be varied and still be contemplated to be within the scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
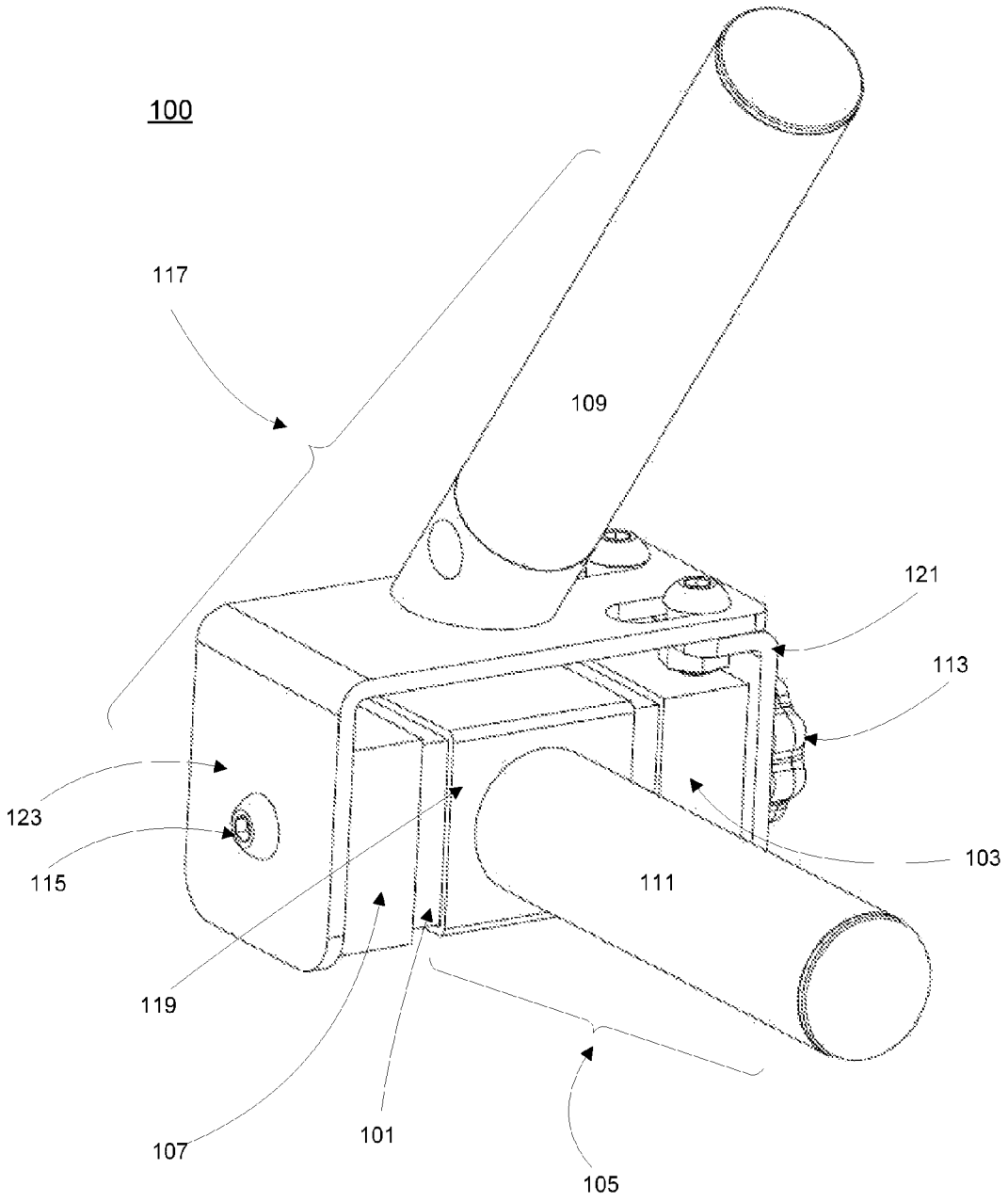
FIG. 1 is a perspective diagram illustrating an embodiment of a torsion pivot device.

FIG. 1 is a perspective diagram illustrating an embodiment of a torsion pivot device. Device 100 may include elastic element 101 shaped longitudinally with an axis. Two or more pivot structures, such as end pivot structure (or pivot assembly) 117 and middle pivot structure 105, may be engaged with separate portions of elastic element 101 along the axis. Pivot structures 105, 117 may be defined to grab over surfaces of separate longitudinal portions of elastic element 101 to allow pivot structures 105, 117 to exert torque force to twist elastic element 101. The torque force may deform elastic element 101 to induce or generate twisting tension to counter the torque force.

An axial guide mechanism (not shown) may be defined through elastic element 101 substantially along a longitudinal axis, for example, between coupling screw 115 and adjustment knob 113. Pivot structures 117, 105 may be rotatably coupled with elastic element 101 via the axial guide mechanism to allow pivot structures 117, 105 to pivot or rotate relative to each other around the longitudinal axis.

An adjustment control may be coupled with the axial guide mechanism to configure the engagement of pivot structures (or assemblies) 105, 117 assemblies with elastic element 101 for varying strength of the twisting tension induced by deformed elastic element 101. For example, the adjustment control may include adjustment knob 113 to allow user configuration of the strength of twisting tension by varying an amount of longitudinal compression applied on elastic element 101. The strength of twisting tension can be increased as a result of additional compression applied to elastic element 101 when the longitudinal length to house elastic element 101 between base plates 121, 123 is shortened.

In one embodiment, elastic element 101 may be made of tendon-like material (e.g. having a pale yellow translucent color) capable of providing counter or resilience forces when deformed. For example, elastic element 101 may include material manufactured based on plastics, such as thermoplastic rubber (TPR) or thermoplastic elastomer rubber, also known as styrene-butadiene-styrene block copolymer. Styrenic thermoplastic elastomers, also known as styrenic block copolymer (SBCs) with rubber (or elastic) resilient properties similar to a thermoplastic elastomer.

Tendon-like material may be based on different types of SBCs, such as styrene-butadiene-styrene block copolymer (SBS), styrene-isoprene-styrene block copolymer (SIS), styrene-ethylene-butylene-styrene block copolymer (SEBS), styrene-ethylene-propylene-styrene block copolymer (SEPS) or other applicable compositions. SEBS and SEPS may be hydrogenated copolymers of SBS and SIS. SBS based styrene-based thermoplastic elastomer may possess material properties of both plastic and rubber (a.k.a. "third generation synthetic rubber"). Tendon like material may include thermoplastic elastomers based on SBS with desired characteristics related to tensile strength, surface friction coefficient, electrical properties, low temperature tolerance, manufacturability, water friendly, weak acid friendly, alkali friendly, and other applicable characteristics.

In one embodiment, separate portions of elastic element 101 engaged with pivot structures may include a middle portion and one or two end portions. The middle portion may be located between two longitudinal ends of elastic element 101. Each end portion may be defined by a longitudinal end of elastic element 101. Middle pivot structure 105 may be engaged with the middle portion of elastic element 101. End pivot structure 117 may be engaged with two (or at least one) end portions of elastic element 101.

Each pivot structure may include at least one housing element to hold elastic element 101. For example, end pivot structure 117 may be configured with end gripper 103, 107; middle pivot structure may be configured with middle gripper 119. Outer surfaces of separate portions of elastic element 101 may be accommodated within housing elements of pivot structures 117, 105. Middle gripper 119 may include a sleeve structure enclosing the middle portion of elastic element 101. Each end gripper 103, 107 may include a cap structure enclosing one of the end portions of elastic element 101.

In certain embodiments, cross section over outer surfaces of elastic element 101 may be non-smoothly shaped (e.g. angularly shaped). Inner surfaces of the housing elements of pivot structures 105, 117 may be shaped substantially conforming or matching to the outer surfaces of elastic element 101 in the non-smoothly shaped manner to allow secure engagement for exerting torque forces. In one embodiment, the cross section of elastic element 101 may be shaped in a rectangular, square or other applicable angular or non-smooth manner.

Device 100 can include multiple torsion arms (e.g. first torsion arm, second torsion arm, etc.) or coupling assemblies to provide external mounting mechanisms for using device 100. For example, torsion arm 109 of end pivot structure 117 may be arranged perpendicularly or angularly (e.g. about 45 degree, 90 degrees, or other applicable angle) with torsion arm 111 of end pivot structure 105 around the longitudinal axis of elastic element 101 in a rest state (e.g. without torque force applied or without being deformed). Torsion arm 111 may be affixed to middle gripper 119 of middle pivot structure 109. Torsion arm 109 may be adjustably affixed to at least one end gripper 103, 107 of end pivot structure 117. Torsion arms 109, 111 may be disposed substantially transverse to the longitudinal axis to elastic element 101.

Figure 2:
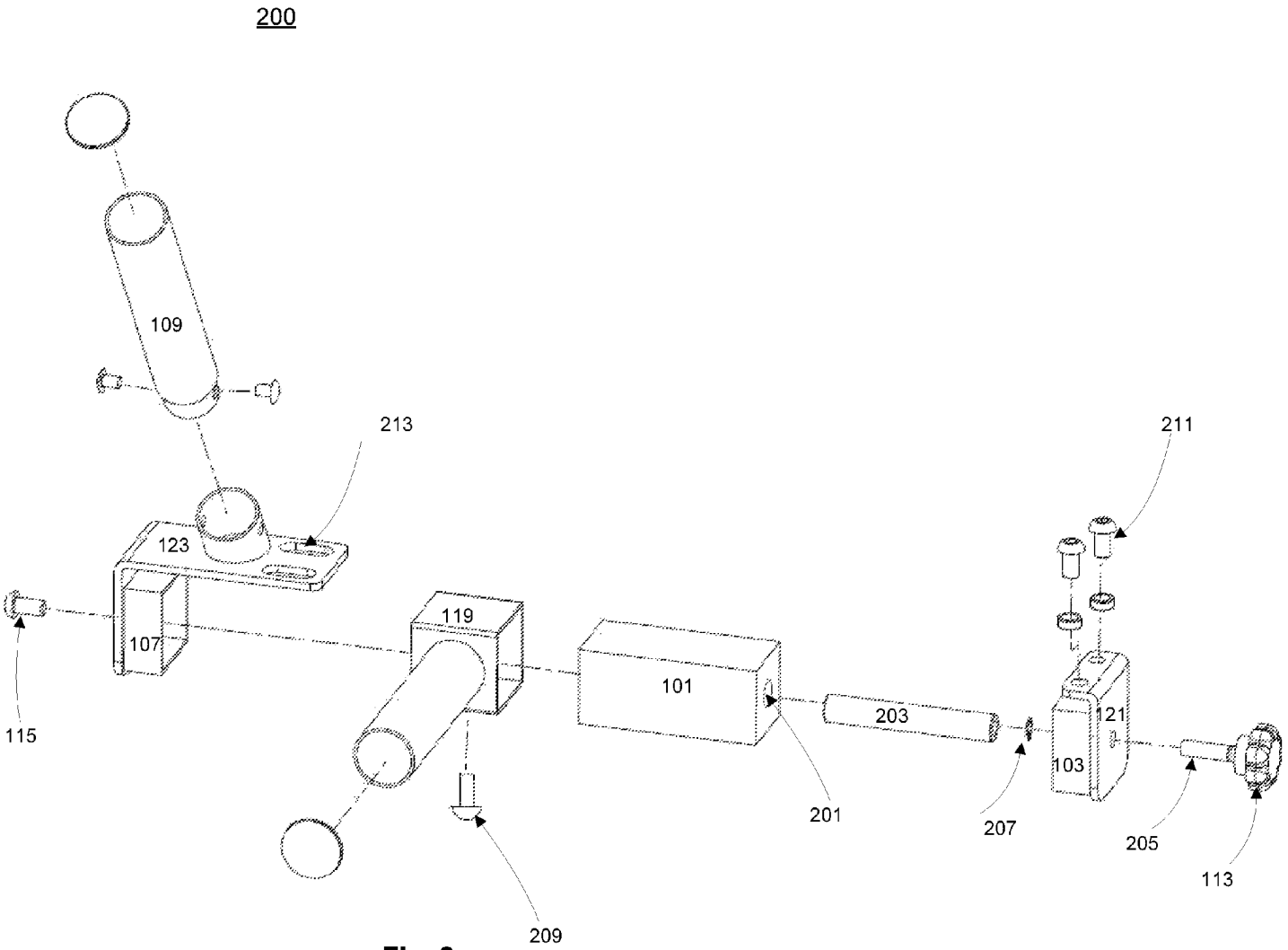
FIG. 2 is a component diagram illustrating an embodiment of a torsion pivot device.

FIG. 2 is a component diagram illustrating an embodiment of a torsion pivot device. For example, view 200 may be based on device 100 of FIG. 1. In one embodiment, end pivot structure may include base plates 121, 123 adjustably affixed via base fastener 211. Fastener slot 213 may be defined over base plate 123 to adjust the distance between end grippers 103, 107 to control twisting tension of elastic element 101.

Elastic element 101 may be defined with a central longitudinal passage (or opening) 201 to house pivot rod 203 for the axial guide mechanism. Pivot rod 203 may be arranged substantially collinear with the longitudinal axis of elastic element 101. End grippers 103, 107 may be rotatably affixed at two longitudinal ends of pivot rod 203 via coupling screw 115, rod fastener 205 and nut 207. In one embodiment, pivot rod 203 may be defined shorter (longitudinally) than elastic element 101 to allow a change of distance between end grippers 103, 107 to compress/decompress elastic element 101, thus varying the strength of twisting tension induced via elastic element 101 (e.g. with same amount of deformation).

Middle gripper 119 may be transversely affixed to pivot rod 203 via transverse screw 209 passing through elastic element 101. Pivot rod 203 may be defined with an opening to receive transverse screw 209 for rotatably coupling with middle gripper 119. In some embodiments, end grippers 103, 107 may be transversely affixed to pivot rod 203 via one or more transverse screws through elastic element 101.

Figure 3:
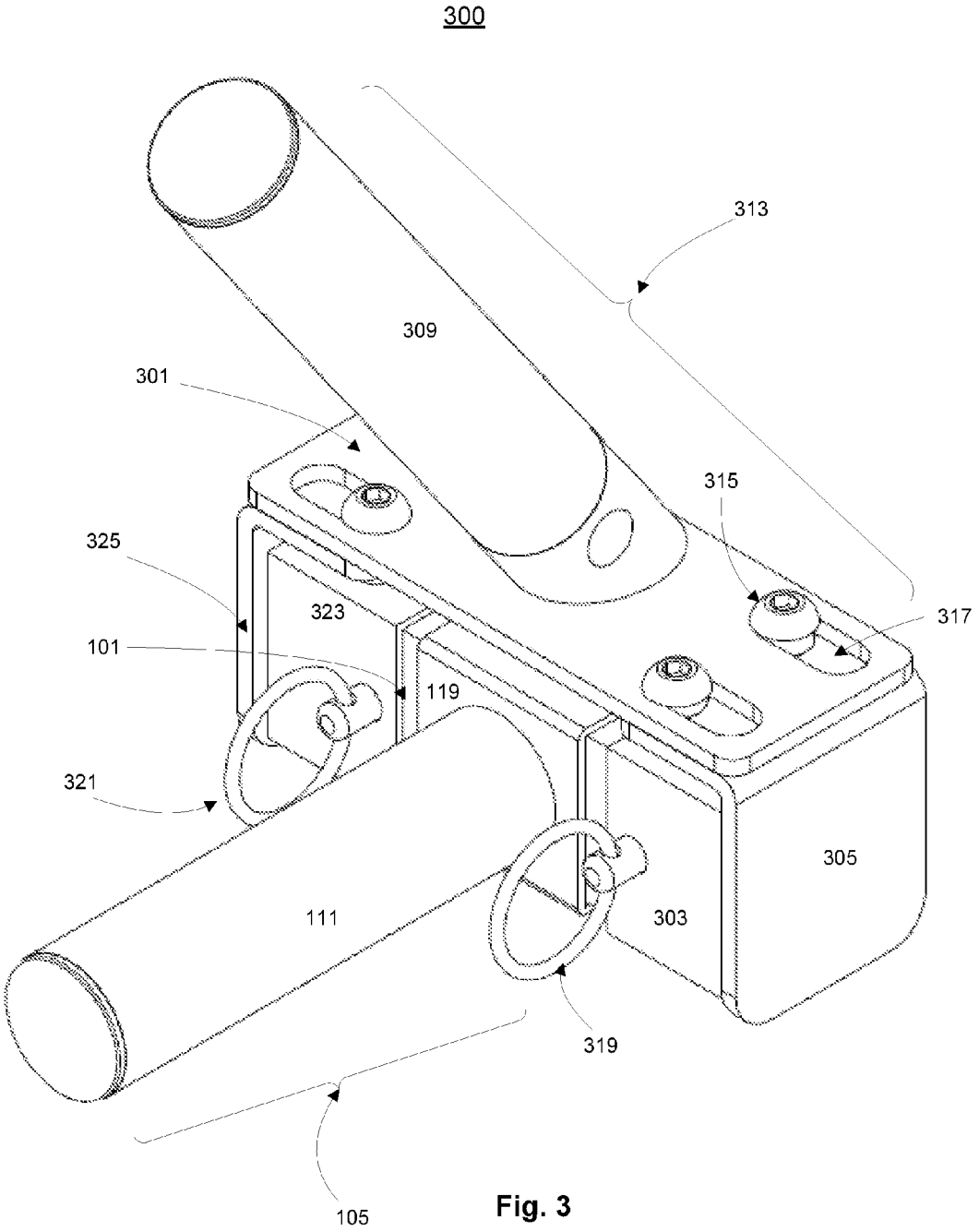
FIG. 3 is a perspective diagram illustrating an alternative embodiment of a torsion pivot device.

FIG. 3 is a perspective diagram illustrating an alternative embodiment of a torsion pivot device. Device 300 may include elastic element 101 engaged with end pivot structure 313 and middle pivot structure 105. End pivot structure 313 may include end grippers 303, 323 separately affixed to base plates 305, 325. Torsion arm 309 may be affixed to coupling plate 301 defined with four fastener slots 317. End grippers 303, 323 may be adjustably fastened to coupling plate 301 via four base fasteners 315 positioned over fastener slots 317, for example, to adjust longitudinal distance between base plates 303, 325 to control compression level of elastic element 101.

In one embodiment, device 300 can include guide control mechanism having transverse inserts 319, 321 together with fasteners 315 to configure engagement between end grippers 323, 303 of end pivot structure 313 with elastic element 101. Different engagements may be configured to vary levels of compression applied to elastic element 101, for example by changing the longitudinal distance between base plates 305, 325 for housing elastic element 101.

In a certain embodiment, the strength of twisting tension induced by elastic element 101 can depend on a twisted shape of elastic element 101. Transverse inserts 319, 321 may be inserted between end grippers 303, 323 and elastic element 101 in different combinations (e.g. both inserted, neither inserted or only one inserted) to configure the engagement for varying the twisting strength of elastic element 101.

Figure 4:
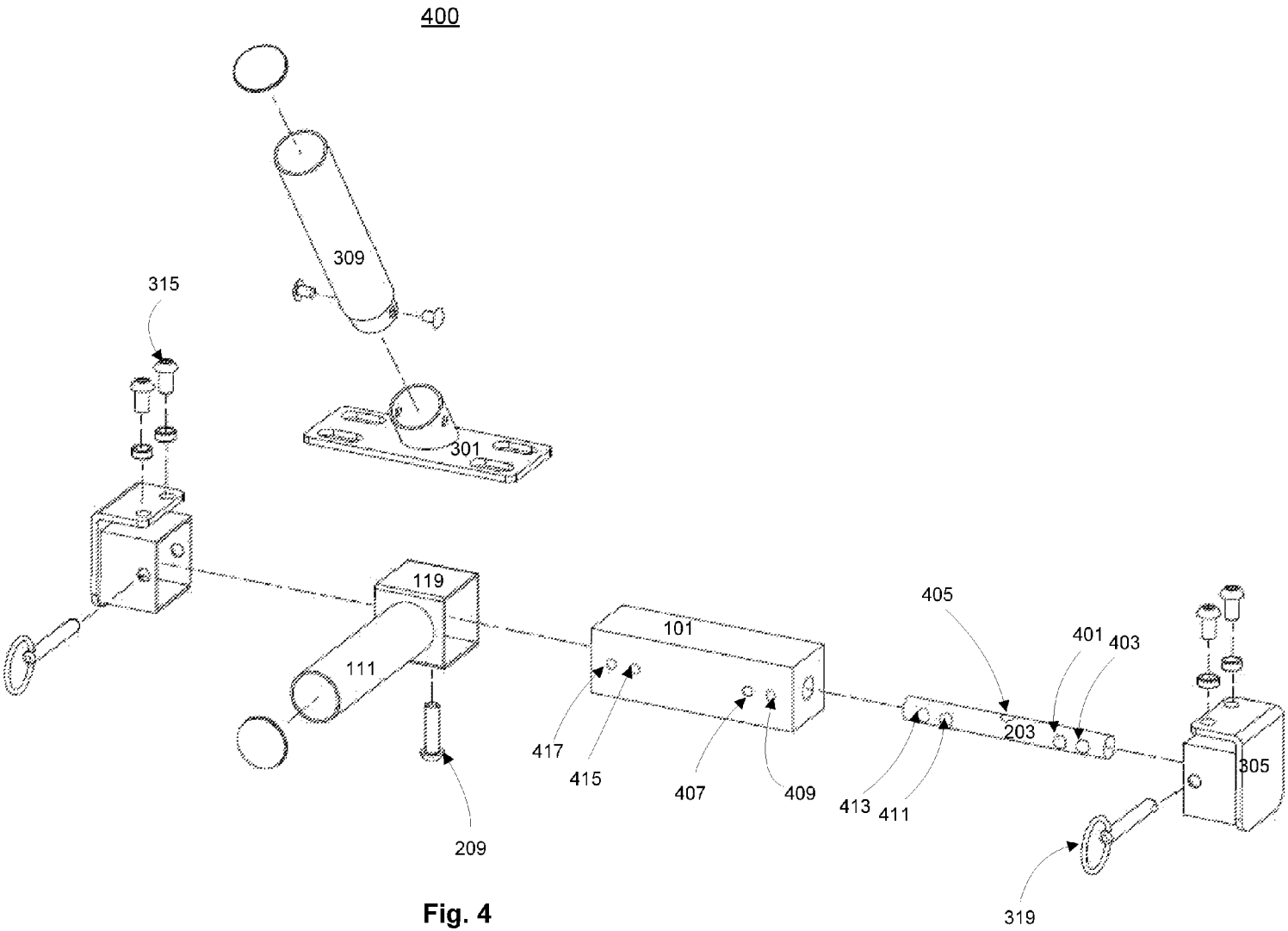
FIG. 4 is a component diagram illustrating an alternative embodiment of a torsion pivot device.

FIG. 4 is a component diagram illustrating an alternative embodiment of a torsion pivot device. For example, view 400 may be based on device 300 of FIG. 3. In one embodiment, device 300 may include an axial guide mechanism having pivot rod 203 defined with a number of openings 401, 403, 405, 411, 413. For example, pivot rod 203 may be configured to receive transverse insert 319 via opening 401 or opening 403 via lateral passages 407 or 409 of elastic element 101 to compress/loosen elastic element 101. Transverse insert 321 may be similarly configured via openings 411, 413 and lateral passages 415, 417.

In some embodiments, middle pivot structure may be engaged with pivot rod 203 via transverse screw 209 via opening 405. Transverse inserts 319, 321 and transverse screw 209 may be selectively inserted to openings along pivot rod 203 to configure different engagements between pivot structures 313, 105 and elastic element 101 for varying the twisting strength of pivoting resilience.

In one embodiment, at least one of multiple pivot structures may not be transversely coupled with a guide mechanism (e.g. based on pivot rod 203) in a torsion pivot device, such as device 300. For example, at least one of transverse inserts 319, 321 and transverse screw 209 may not be inserted to the openings of pivot rod 203 to allow angular movements between pivot structures 313, 105. Alternatively, or optionally, device 300 may be configured without insertions of transverse inserts 319, 321 and transverse screw 209.

Figure 5:
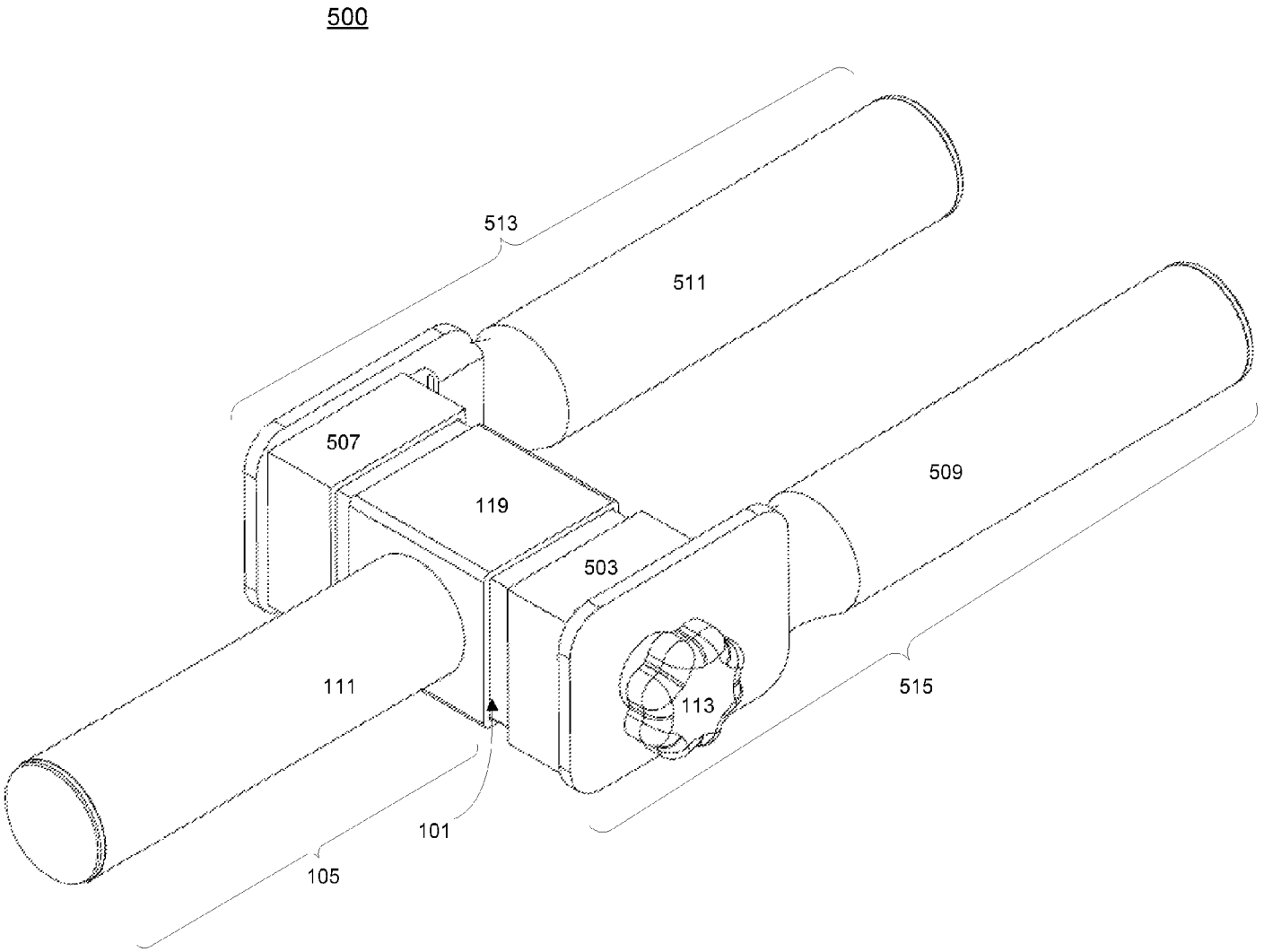
FIG. 5 is a perspective diagram illustrating an embodiment of a torsion pivot device having more than two torsion arms.
Figure 7:
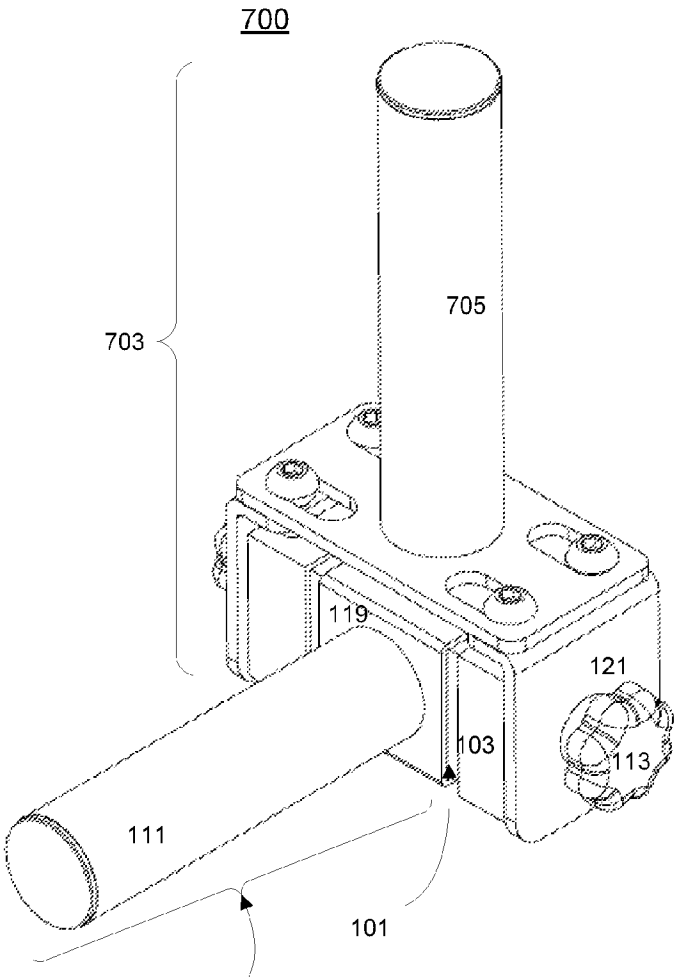
FIGS. 6-11 perspective diagrams illustrating various embodiments of a torsion pivot device.
Figure 6:
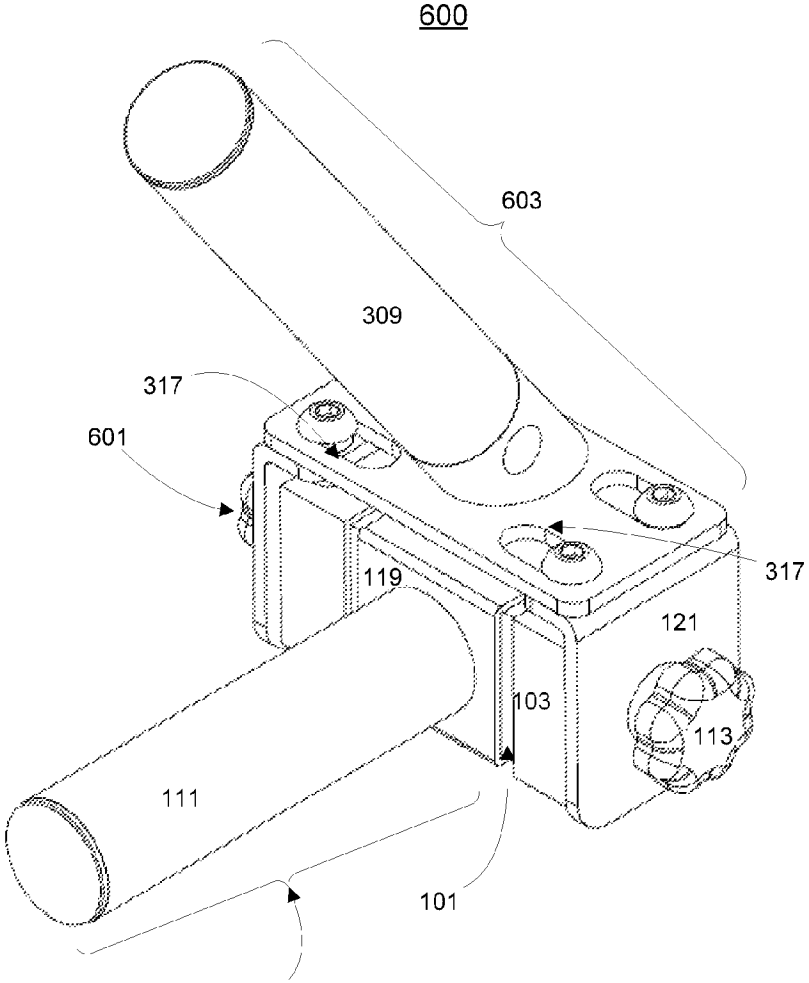

FIG. 5 is a perspective diagram illustrating an embodiment of a torsion pivot device having more than two torsion arms. For example, device 500 may include end pivot structures (e.g. second pivot structure and third pivot structure) 513, 515 and middle pivot structure (e.g. first pivot structure) 105 rotatably coupled with elastic element 101. End pivot structure 513 may include end gripper 507 (e.g. first end gripper). End pivot structure 515 may include end gripper 503 (e.g. second end gripper).

Middle pivot structure 105 may include torsion arm 111 disposed substantially towards a transverse direction of the axis of elastic element 101 for external mounting mechanism. Torsion arms 511, 509 may be arranged substantially parallel to each other extending towards a common transverse direction opposite to the transverse direction of torsion arm 111 with respect to the longitudinal axis of elastic element 101 at a rest state (e.g. elastic element 101 not deformed).

FIGS. 6-10 are perspective diagrams illustrating various embodiments of a torsion pivot device. For example, device 600 may be configured with two adjustment knobs 113, 601 with end pivot structure 603, middle pivot structure 105 and elastic element 101. Multiple adjustment knobs or controls may be configured in a torsion pivot device to accommodate user needs for ease of torque tension adjustment. For example, multiple fastener slots 317 can provide additional range of compression on elastic element 101 based on combined length of slot tracks in fastener slots 317.

Pivot structures 105, 603 may include torsion arms arranged angularly between each other with an angle less than 90 degrees when elastic element 101 is at a rest state (e.g. without external forces applied or without being deformed). Device 700 of FIG. 7 may be configured with pivot structures 105, 703 including torsion arms 111, 705 (or other external coupling mechanisms) arranged substantially perpendicular to each other when device 700 (or elastic element 101) is at a rest state.

Figure 8:
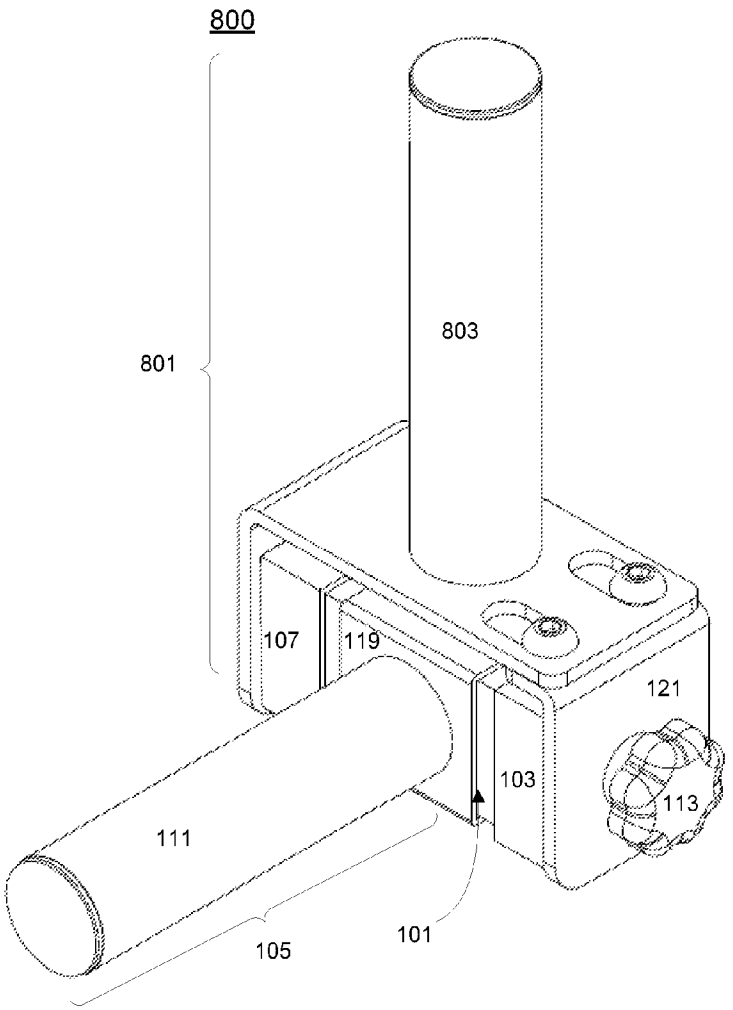

Turning now to FIG. 8, device 800 may be configured with pivot structures 105, 801 including torsion arms 111, 803 arranged substantially perpendicular to each other around a longitudinal axis of elastic element 101 at a rest state. Device 800 may include similar adjustment control mechanisms as in device 100 of FIG. 1.

Figure 9:
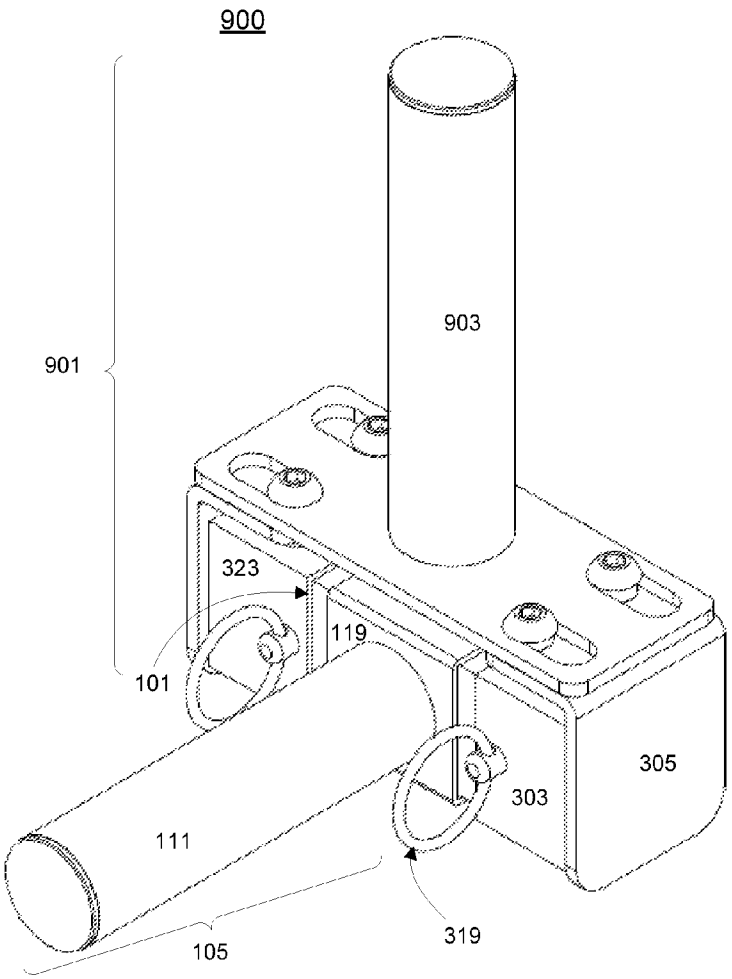

Turning now to FIG. 9, device 900 may be configured with pivot structures 105, 901 including torsion arms 111, 903 arranged substantially perpendicular to each other around a longitudinal axis of elastic element 101 at a rest state. Device 900 may include similar adjustment control mechanisms as in device 300 of FIG. 3.

Figure 10:
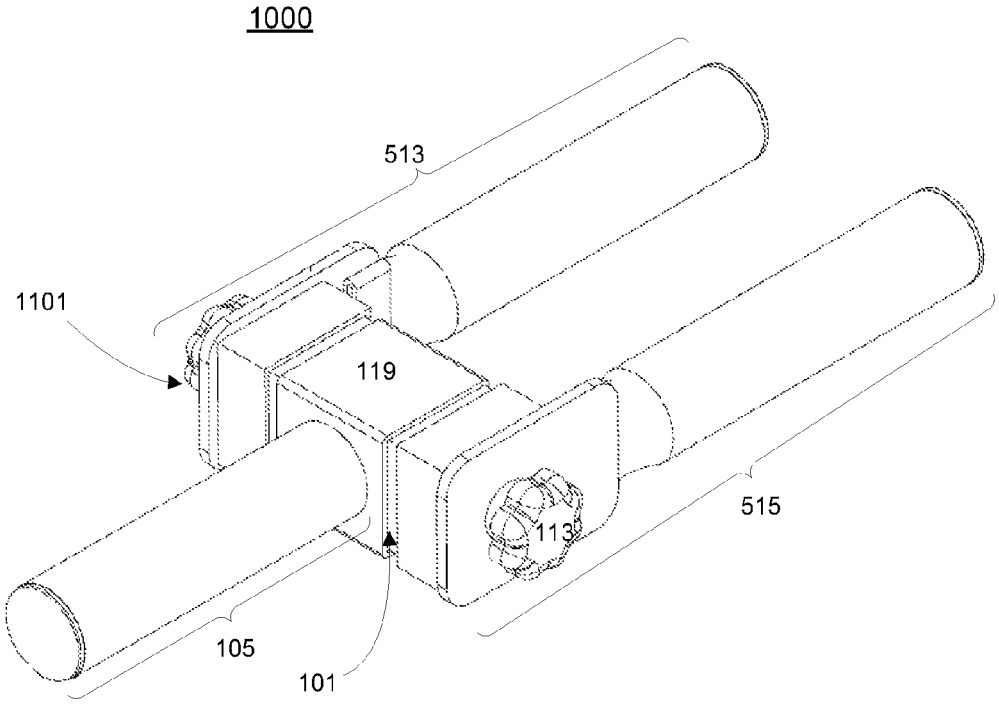
Figure 11:
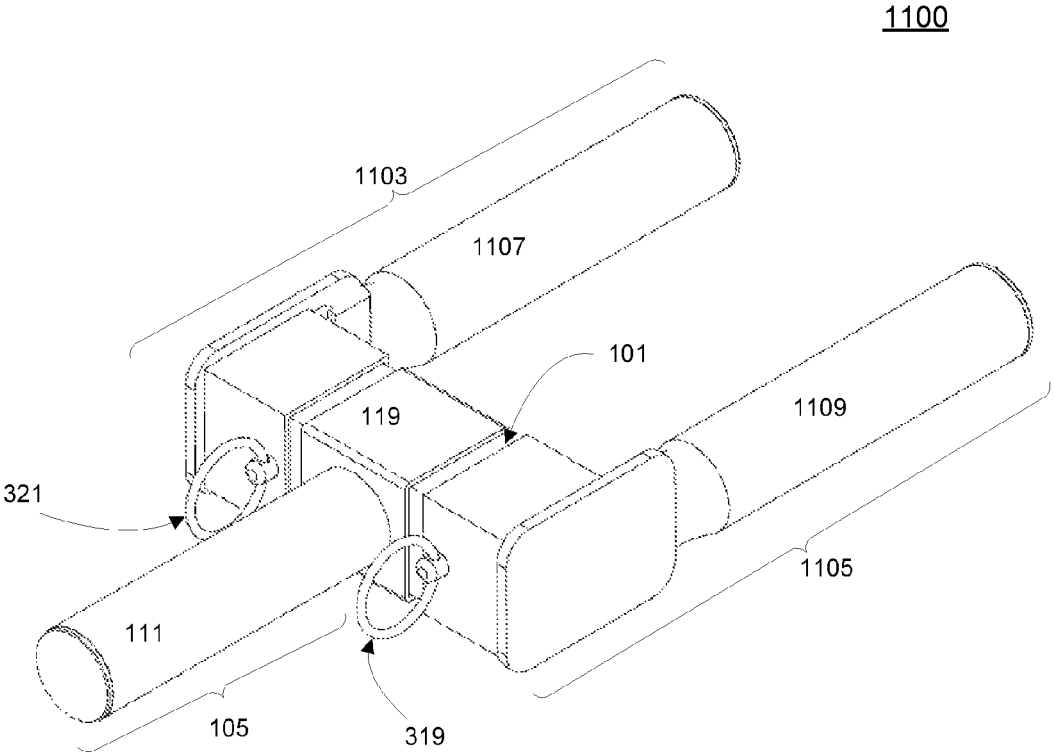

Turning now to FIG. 10, device 1000 may be arranged with multiple adjustment knobs 113, 1101. Device 1000 may include multiple pivot structures 105, 513, 515 similar to device 500 of FIG. 5. Device 1100 of FIG. 11 may be configured with pivot structures 105, 1101, 1103 having torsion arms 111, 1105, 1107 arranged substantially parallel to each other at a rest state. Device 1100 may include adjustment mechanisms based on transverse inserts 319, 321 similar to device 300 of FIG. 3.

Figure 12:
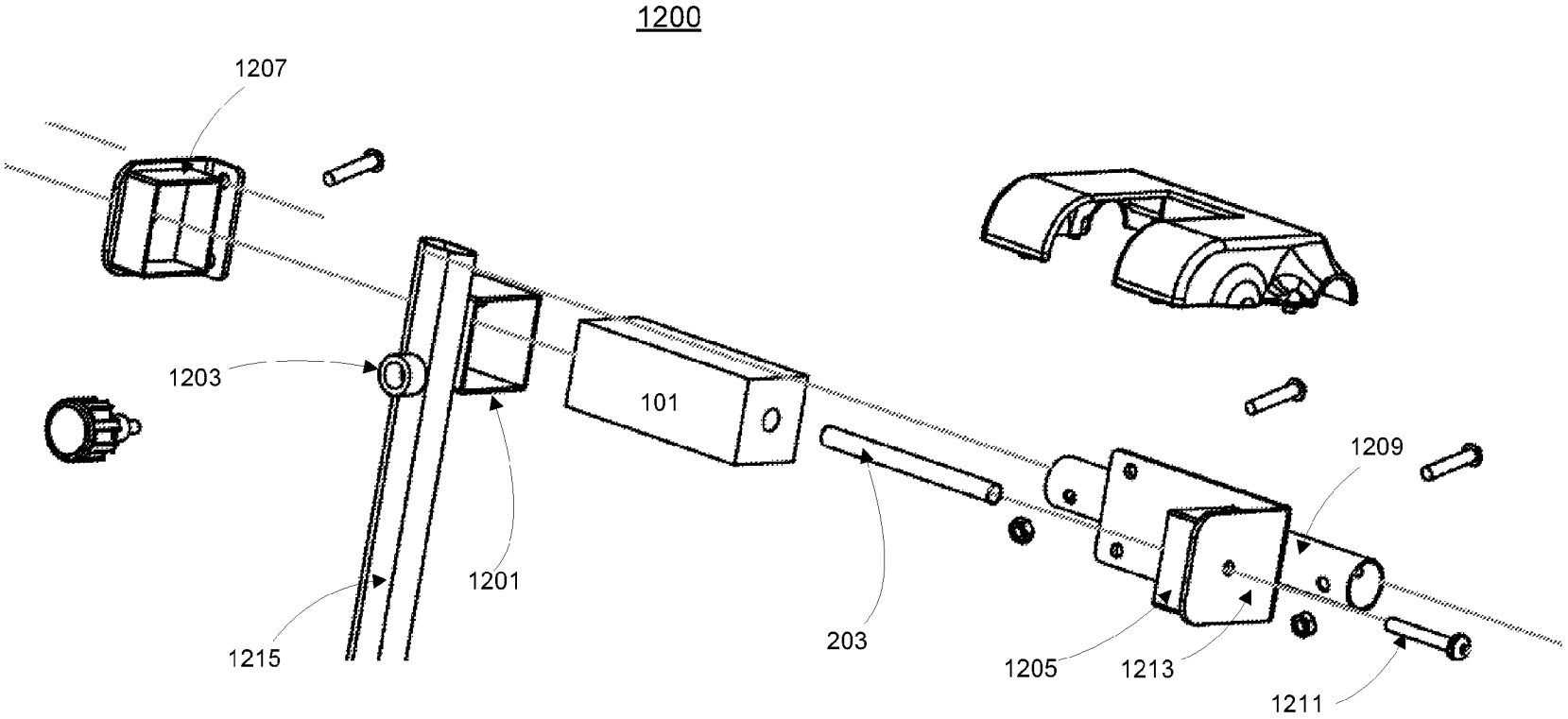
FIG. 12 is a component diagram illustrating another embodiment of a torsion pivot device.

FIG. 12 is a component diagram illustrating another embodiment of a torsion pivot device. View 1200 may demonstrate a middle pivot structure including middle gripper 1201 affixed to an external frame, such as frame 1215 of an exercise device, via mounting screw 1203. Middle gripper 1201 may be configured as a sleeve structure to receive elastic element 101. An end pivot structure may include end grippers 1207, 1205 and base plate 1213 affixed with mounting tube 1209. Illustratively, the end pivot structure may pivot around pivot rod 203 with the middle pivot structure fixated to an exercise machine via frame 1215 to generate resilient torque force around elastic element 101.

Many modifications and other embodiments of the invention set forth herein will come to mind to one skilled in the art to which the invention pertains to having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A torsion pivot assembly comprising:

an elastic element having an axis in a longitudinal direction, wherein elastic element includes a first end portion, a middle portion, and a second end portion;

a first pivot structure engaged with the first and second end portions of the elastic element along the axis, a second pivot structure engaged with the middle portion of the elastic element along the axis, the engagements to allow the pivot structures to exert torque force to the respective portions of the elastic element wherein the first pivot structure includes a first torsion arm extended outwardly with respect to the axis of the elastic element and the second pivot structure includes a second torsion arm extended outwardly with respect to the axis of the elastic element, wherein the first and second torsion arms are substantially perpendicular to the axis of the elastic element in the longitudinal direction;

a U-shape frame having a bottom section and two wing sections, wherein the two wing sections of the U-shape frame are fixedly coupled to the first and second end portions of the elastic element, respectively wherein the first pivot structure is fixedly coupled to the bottom section of the U-shape frame, wherein the second pivot structure is fixedly coupled to the middle portion of the elastic element, such that when the first torsion arm rotates with respect to the second torsion arm, the middle portion of the elastic element is twisted against the first and second end portions of the elastic element fixedly held by the wing sections of the U-shape frame;

an axial guide mechanism defined through the elastic element substantially along the axis, wherein the pivot structures are rotatably coupled with the elastic element via the axial guide mechanism to allow the pivot structures to pivot relative to each other around the axis, the torque force to deform the elastic element via the pivoting of the pivot structures to generate twisting tension to counter the torque force via the elastic element when a force is applied to the first torsion arm or the second torsion arm.

2. The assembly of claim 1, wherein each pivot structure has at least one housing element, wherein outer surfaces of the separate portions of the elastic element are accommodated within the housing elements of the pivot structures.

3. The assembly of claim 2, wherein a cross section of the outer surfaces of the elastic element are non-smoothly shaped, wherein inner surfaces of the housing elements are shaped substantially conforming to the outer surfaces of the elastic element in the non-smoothly shaped manner to allow the engagement.

4. The assembly of claim 3, wherein the cross section is squarely shaped.

5. The assembly of claim 2, wherein the pivot structures include a middle pivot structure and at least one end pivot structure, the middle pivot structure engaged with the elastic element via the middle portion, the at least one end pivot structure engaged with the elastic element via at least one of the end portions.

6. The assembly of claim 5, wherein the middle pivot structure includes a middle gripper having a housing element configured as a sleeve, the middle portion of the elastic member positioned within the sleeve.

7. The assembly of claim 5, wherein the at least one end pivot structure includes at least an end gripper having a housing element configured as a cap enclosing one of the end portions of the elastic element.

8. The assembly of claim 5, wherein a central passage is defined longitudinally through the elastic element and wherein the axial guide mechanism comprises:

a pivot rod housed within the central passage of the elastic element, the pivot rod substantially collinear with the axis of the elastic element.

9. The assembly of claim 8, wherein an end gripper is rotatably affixed to the pivot rod longitudinally.

10. The assembly of claim 8, wherein strength of the twisting tension via the elastic element is adjustable, further comprising:

an adjustment control to configure the engagement of the pivot structures with the elastic element to adjust the strength of the twisting tension.

11. The assembly of claim 10, wherein the pivot rod is shorter than a longitudinal length of the elastic element and wherein the adjustment control allows changes of longitudinal length of the elastic element to compress or loosen the elastic element to strengthen or weaken the twisting tension.

12. The assembly of claim 11, wherein a middle gripper is transversely affixed to the pivot rod via a transverse screw through the elastic element.

13. The assembly of claim 1, wherein the elastic element includes tendon based material to provide the twisting tensions when deformed.

* * * * *